United States Patent [19]

Sowinski

[11] 3,979,867

[45] Sept. 14, 1976

[54] NAILABLE FOAM FACED BOARD

[75] Inventor: Gerard T. Sowinski, Lancaster, N.Y.

[73] Assignee: National Gypsum Company, Buffalo, N.Y.

[22] Filed: June 20, 1975

[21] Appl. No.: 588,778

[52] U.S. Cl. ..... 52/309; 52/364; 52/741

[51] Int. Cl.[2] ..... E04C 1/00

[58] Field of Search ..... 52/309, 376, 368, 364, 52/617, 622, 443, 741; 428/223

[56] References Cited

UNITED STATES PATENTS

| | | | |
|---|---|---|---|
| 3,258,889 | 7/1966 | Butcher | 52/309 |
| 3,362,120 | 1/1968 | Warren | 52/376 X |
| 3,922,828 | 12/1975 | Patton | 52/309 X |

*Primary Examiner*—Ernest R. Purser
*Assistant Examiner*—Carl D. Friedman
*Attorney, Agent, or Firm*—Robert F. Hause

[57] ABSTRACT

A wood excelsior board having a rigid polyurethane foam insulation layer foamed-in-place on one face thereof, and a plurality of thin elongate nailing strips disposed at the foam to board interface, with a thin elongate ridge in the outer surface of the foam for readily locating the disposition of the nailing strip thereunder.

8 Claims, 3 Drawing Figures

NAILABLE FOAM FACED BOARD

This invention relates to the incorporation of a nailing strip within a foam-backed roof deck panel and particularly to the formation of a ridge in the foam surface for locating the nailing strip.

A highly desirable roof deck consists of composite panels of attractive, low density, wood excelsior board with a foamed-in-place layer of rigid polyurethane foam disposed throughout the top side thereof. After constructing a roof deck of these composite panels, a built-up roof of roofing felt and asphalt is laid over the panels, on the typical flat roof, or shingles, roofing tiles or other protective coverings are affixed thereover on the typical pitched roof.

Various adhesive means have been employed in affixing materials over the top surface of the rigid foam. A suitable means for mechanical attachment to the top of the composite panel is urgently needed.

It is an object of the present invention to provide a novel composite panel of wood excelsior and rigid foam with a readily available means for mechanical attachment to the foam face.

It is a further object to provide a method of making an improved composite panel having a foamed-in-place rigid foam face layer.

It is a still further object to provide an improved roof comprising foam-backed roof deck panels.

These and other objects of the invention will be more readily apparent when considered in relation to the preferred embodiment as set forth in the specification and shown in the drawings in which.

Figure 1:
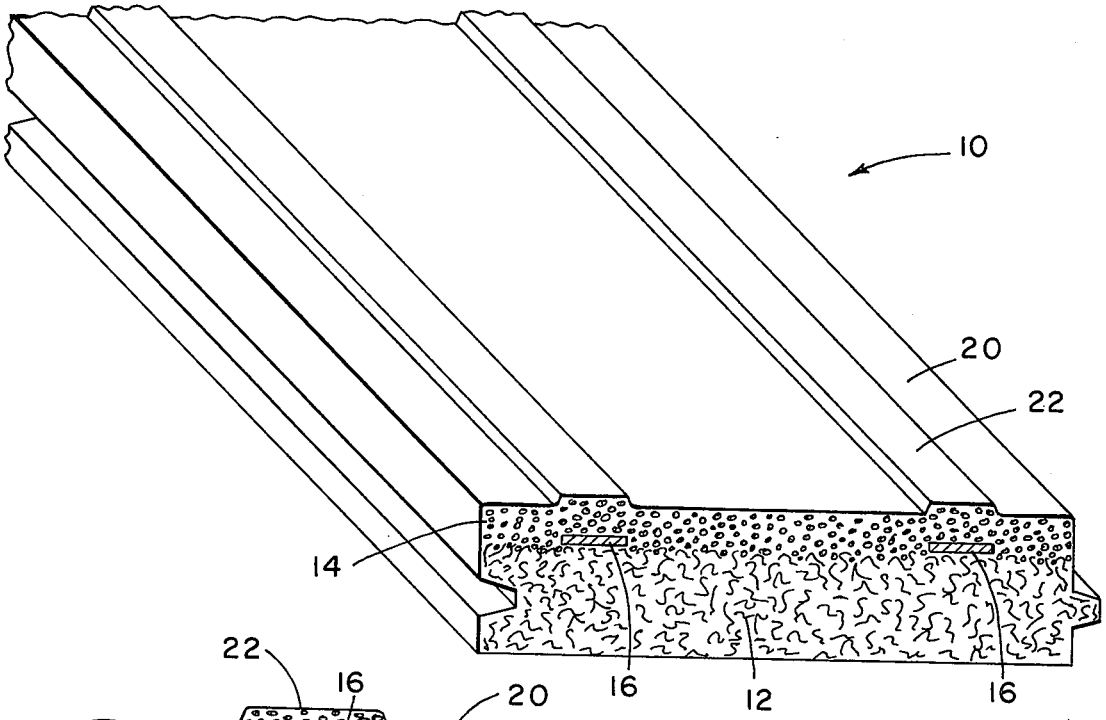
FIG. 1 is an isometric view of an end of a composite panel embodying the present invention.
Figure 2:
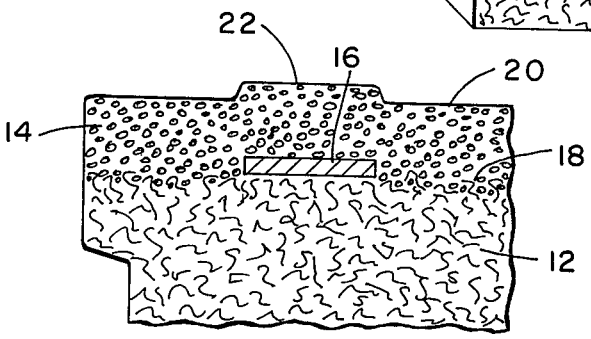
FIG. 2 is an enlarged view of a portion of the end of the panel of FIG. 1.

Referring to FIG. 1, there is shown a composite panel 10 consisting of a main body portion 12, a top foam facing 14 of foamed-in-place rigid polyurethane foam, and two elongate thin strips 16 of 2 inch (5 cm) wide, 0.02 inch (0.05 cm) thick galvanized sheet steel.

The main body portion 12 is formed of a low density mass of long fine wood excelsior bonded together with a magnesium oxychloride inorganic cement binder. The foam facing 14, which was foamed in place, extends about ⅛ inch (0.3 cm) into the pores 18 of the wood excelsior main body portion 12.

The panels are preferably from about two to four feet (0.6 to 1.2 meters) wide, about 4 feet to 12 feet (1.2 to 3.6 meters) long and have thicknesses of the body portion of from two to three inches (5 to 7.5 cm) and of the rigid foam of from ¾ inch to 1½ inch (2 to 4 cm).

Panels formed generally as described above consisting only of the wood excelsior body and the rigid polyurethane foam, and excluding strips 16, are presently marketed under the trademark TECTUM II, by National Gypsum Company.

In accordance with the present invention, the panels 10 further include the two strips 16, firmly affixed at the interface of the body portion 12 and the rigid foam facing 14. The strips 16 extend parallel to the long dimension of the panels 10.

The foam facing 14 does not extend at all into the pores 18 of the body portion at those areas of the surface of the body portion covered by the strips 16. The foam facing 14 has a top external surface 20 which is generally flat with the exception of raised ridges 22 which are located over the total extent of the area of the strips 16. The ridges have a thickness which is most often slightly thicker than the thickness of the strips 16.

The thickness of ridges 22 is of importance in the invention only in that it be enough to make the ridge readily noticeable. During the foaming-in-place of the foam, that portion of the foaming polyurethane which is located over strips 16 is prevented from penetrating into the pores 18. As a result an amount of foam is formed over the strips which is displaced upwardly which theoretically equals the thickness of strip 16 and the amount of material which normally enter pores 18.

Strips 16 can be of any material suitable for receiving and holding fasteners driven thereinto. The strips could be 2 inch (5 cm) wide 3/16 inch (0.5 cm) thick plywood.

Figure 3:
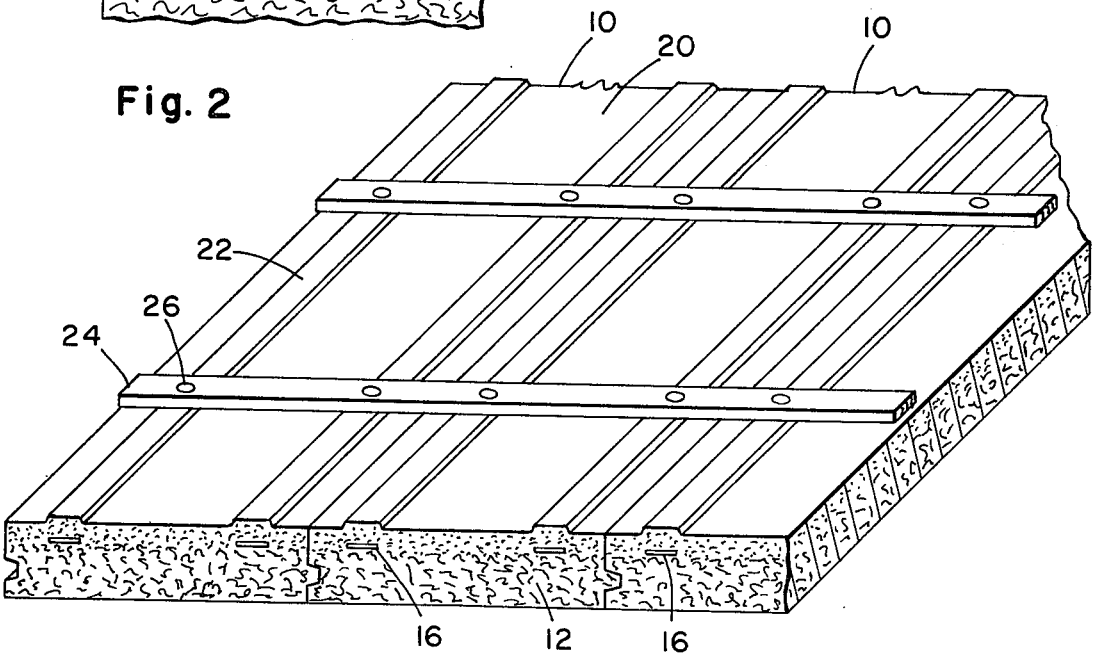
FIG. 3 is an isometric view of the edge portion of a pitched roof with furring strips nailed to the composite panels.

In FIG. 3, a pitched roof deck of panels 10 is shown with furring strips 24 screwed thereto with Type S, self-threading screws 26 extending through the furring strips, the foam and the metal strips 16, with at least about two threads length of screw projecting through strips 16. Any of many kinds of roofing shingles and roof tiles can be mechanically affixed to the roof deck by nailing them to the furring strips. Instead of furring strips 24, plywood sheets can be screwed to the metal strips 16. On a flat roof, roofing felt can be nailed directly to the foam surface 20 by locating nails, using ridges 22, to extend through strips 16.

Having completed a detailed disclosure of the preferred embodiments of my invention so that those skilled in the art may practice the same, I contemplate that variations may be made without departing from the essence of the invention or the scope of the appended claims.

I claim:

1. In combination, a rigid structural board, a foamed-in-place layer of rigid plastic insulating foam adhered to one face of said board and an elongate thin fastener-retaining strip disposed along the interface of said board and said rigid foam, said strip being substantially thinner than said foam layer, said board having a sufficient degree of porosity at said interface whereby said foam, being foamed-in-place, has portions extending into the pores of said board, and an elongate thin ridge formed in the outer surface of said foam directly outward from the location of said fastener-retaining strip.

2. The combination of claim 1 wherein said board is formed of a mass of long fine wood excelsior.

3. The combination of claim 1 wherein said rigid plastic insulating foam is a polyurethane foam.

4. The combination of claim 1 wherein said fastener-retaining strip is a thin sheet steel strip.

5. The combination of claim 1 wherein said foam extends into said pores about ⅛ inch.

6. The combination of claim 1 wherein said ridge in the outer surface is thicker than the thickness of said fastener-retaining strip.

7. A roof comprising a plurality of rigid structural boards as defined in claim 1.

8. The method of making a rigid porous structural board and rigid foam laminate comprising the steps of disposing a plurality of thin fastener-retaining strips on the top face of a rigid porous structural board while leaving a major portion of said top face uncovered, depositing a layer of foamable plastic over said board and said strips, foaming said plastic with portions thereof entering pores of said board in areas between said strips and with portions over said strips forming raised ridges located over said strips.

* * * * *